United States Patent [19]

Brehm

[11] 4,120,144

[45] Oct. 17, 1978

[54] DEVICE FOR FRICTION FALSE-TWISTING OF TEXTILE YARNS OF SYNTHETIC MATERIAL

[75] Inventor: Gustav Brehm, Wattwil, Switzerland

[73] Assignee: Heberlein Maschinenfabrik AG., Wattwil, Switzerland

[21] Appl. No.: 740,081

[22] Filed: Nov. 9, 1976

[30] Foreign Application Priority Data

Nov. 24, 1975 [CH] Switzerland ..... 15115/75

[51] Int. Cl.[2] ..... D02G 1/04

[52] U.S. Cl. ..... 57/77.4; 57/77.45

[58] Field of Search ..... 57/77.3–77.45

[56] References Cited

U.S. PATENT DOCUMENTS

| | | | |
|---|---|---|---|
| 3,919,833 | 11/1975 | Horvath et al. | 57/77.4 |
| 3,964,248 | 6/1976 | Schuster | 57/77.4 |
| 3,973,383 | 8/1976 | Yu | 57/77.4 |

*Primary Examiner*—John Petrakes

*Attorney, Agent, or Firm*—Larson, Taylor and Hinds

[57] ABSTRACT

Friction false-twisters for textile yarn are described in which the yarn passes sinuously and in zig-zag fashion past the edges of overlapping circular rotating members distributed between and fixed to three parallel rotating shafts having their axes parallel and located, in plan view, at the corners of an equilateral triangle. The intermediate members are simple rotary discs but the member that receives the yarn and that from which it is withdrawn are hemispheres or hemiellipsoids respectively on two of the shafts, or both on the same shaft, and facing in opposite directions. The yarn is fed perpendicular to the shaft axis to the convex end of one hemisphere and withdrawn from the convex end of the other hemisphere either perpendicular to or at an angle between 50° and 80° to the shaft axis. All three shafts rotate at the same speed in the same sense.

3 Claims, 3 Drawing Figures

DEVICE FOR FRICTION FALSE-TWISTING OF TEXTILE YARNS OF SYNTHETIC MATERIAL

FIELD OF THE INVENTION

The present invention relates to a device for friction false-twisting of textile yarns of synthetic material for the purpose of crimping the yarn.

DESCRIPTION OF THE PRIOR ART

Devices of this kind are known in various embodiments, the textile yarn to be false-twisted being maintained in contact with and moving past several friction discs arranged one after another in the direction of yarn movement. The friction discs are axially spaced on two or three substantially parallel, rotatably supported shafts which are driven so as to rotate in the same sense, the friction discs on each rotary shaft overlapping the friction discs of the other rotary shaft or shafts (British Patent No. 854,781). In devices with three rotary shafts, it is furthermore known to arrange them so that they, when viewed from above, form the corners of an approximately equilateral triangle so that the textile yarn to be false-twisted moves past the overlapping friction discs in a zig-zag path (German Patent Application 2,213,147).

In the case of known friction discs of the above-mentioned kind, particularly to avoid yarn breakages and for assuring reliability of false-twist formation, very high precision is required in the production and the mounting of the friction discs, having regard to the properties of the textile yarn to be false-twisted. The tolerances which are necessary to achieve satisfactory, approximately equal crimp yarn quality with several textile yarns of the same kind on different devices and to keep the number of yarn breakages within acceptable limits is very difficult to achieve in practice.

SUMMARY OF THE INVENTION

Accordingly, the purpose of the present invention is to provide a false-twister, comprising overlapping friction discs arranged at certain distances from each other on parallel rotary shafts, in which reliable false-twisting is assured without inadmissible strains exerted on the yarn.

According to the present invention, this problem is resolved by providing, on the rotary shafts, uppermost and lowermost friction elements which, when viewed in the direction of the length of yarn passing through the device, each presents a convex surface of revolution such as a hemisphere or hemi-ellipsoid and means for feeding and for withdrawing the textile yarn transversely with respect to the rotary shafts.

Due to the fact that the feeding and withdrawal of the textile yarn to be false-twisted is effected transversely with respect to the axis of the rotary shaft of the hemispherical or hemi-ellipsoidal element, the yarn is applied in practice only onto the vaulted surface of this element and is pressed against the surface by the yarn tension. Thereby, soft yarn feed and withdrawal is achieved which avoids excessive yarn tension and results in stable yarn movement. The false-twister accordingly permits larger tolerances in the production of the device and in the mounting and the adjusting of the friction discs than is the case with the known devices.

The hemispherical or hemi-ellipsoidal or similar elements for yarn feed and removal may be arranged on the same or on different rotary shafts. Yarn feeding may preferably be effected perpendicularly with respect to the axis of rotation. Yarn removal, depending on the kind of textile yarn, may be effected perpendicularly with respect to the axis of rotation or at an angle of between 50° and 80° with respect to that axis.

DESCRIPTION OF THE DRAWINGS

In order that the invention may be clearly understood and readily carried into effect, friction false-twisters will now be described, by way of example, with reference to the accompanying drawings, in which.

Figure 1:
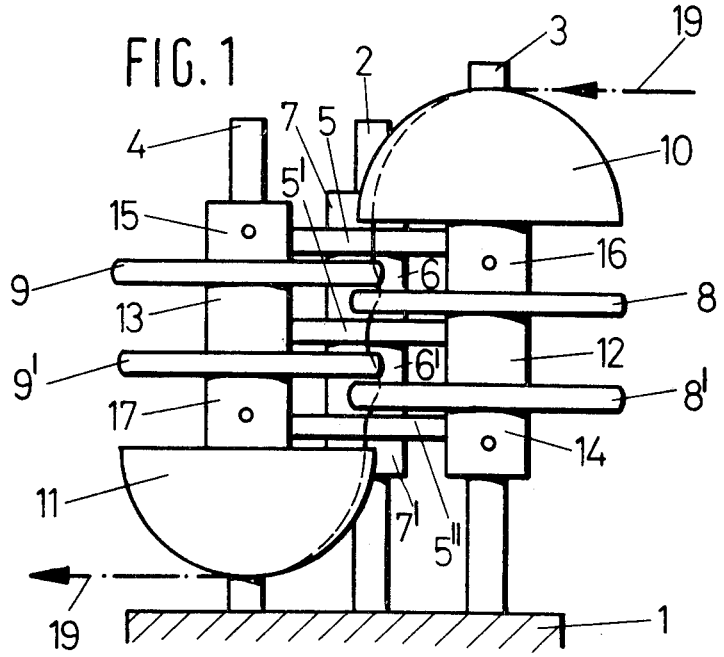
FIG. 1 is a front elevation of a false-twister.
Figure 3:
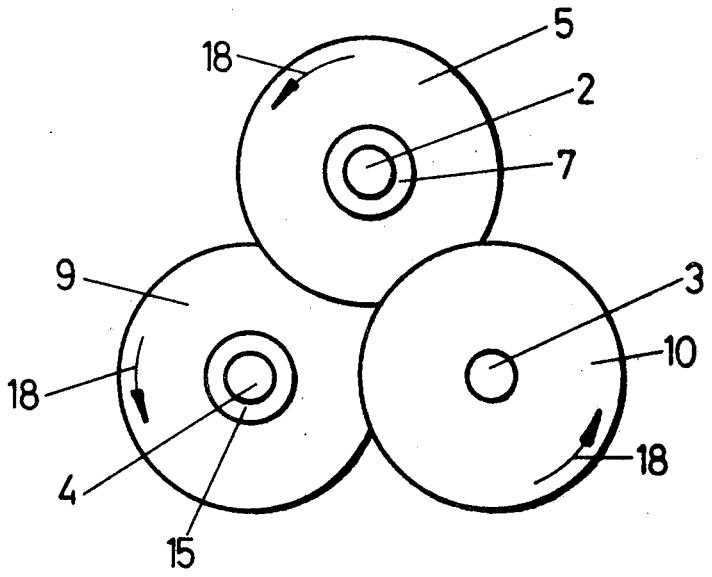
FIG. 3 is a plan view applicable to both FIGS. 1 and 2.

The false-twisting device shown in FIG. 1 comprises a base plate 1 which supports three rotary shafts 2, 3, 4. These are arranged in parallel with each other and form, when viewed from above, the corners of an approximately equilateral triangle, as shown in FIG. 3. All three shafts are driven as is usual in the art by means of a belt (not shown), all the discs rotating in the same sense of rotation and at the same speed.

On the rotary shaft 2, three rotary discs 5, 5′, 5″ are mounted in spaced relation with each other, being spaced by intermediate spacer sleeves 6, 6′ and secured by rings 7, 7′ fixed to the shaft 2 by set screws.

On each of the rotary shafts 3 and 4, there are arranged two friction discs 8, 8′ and 9, 9′ and a hemisphere 10, 11. The friction discs are separated from each other by spacer sleeves 12, 13 and fixed by means of rings 14, 15 secured to the shafts 3, 4 by set screws. Two further rings 16, 17 are rigidly connected with the hemispheres 10, 11 and also secured to the shafts 3, 4 by set screws.

The friction discs 5, 5′, 5″, 8, 8′, 9, 9′ overlap mutually and rotate in the same sense in operation, for example as indicated by arrows 18 in FIG. 3. The textile yarn 19 is fed over the surface of the hemisphere 10 in a direction perpendicular with respect to the shaft 3, and travels past the overlapping edges of the friction discs while in contact therewith so as to traverse a zig-zag path to be finally removed from the device over the surface of the hemisphere 11.

The ends of the rotary shafts 3 and 4 extending beyond the hemispheres 10 and 11 serve as thread-guides for the textile yarn 19 being fed to the device and withdrawn therefrom.

The friction discs 5, 5′, 5″, 8, 8′, 9, 9′ as well as the hemispheres 10, 11 or their surfaces in contact with the textile yarn consist of a material having a high coefficient of friction with respect to textile yarns of synthetic material, the hemispheres or their surfaces being preferably of polyurethane synthetic material. However, also other materials can be used, such as for example aluminium or metal oxide ceramic material provided with oxide coating to provide a friction surface for the textile yarn.

The shafts 2, 3, 4 are mutually adjustable in a manner not shown in directions perpendicular to their axes. Thereby, the overlapping of the friction discs can be adjusted in accordance with the textile yarn to be treated.

Figure 2:
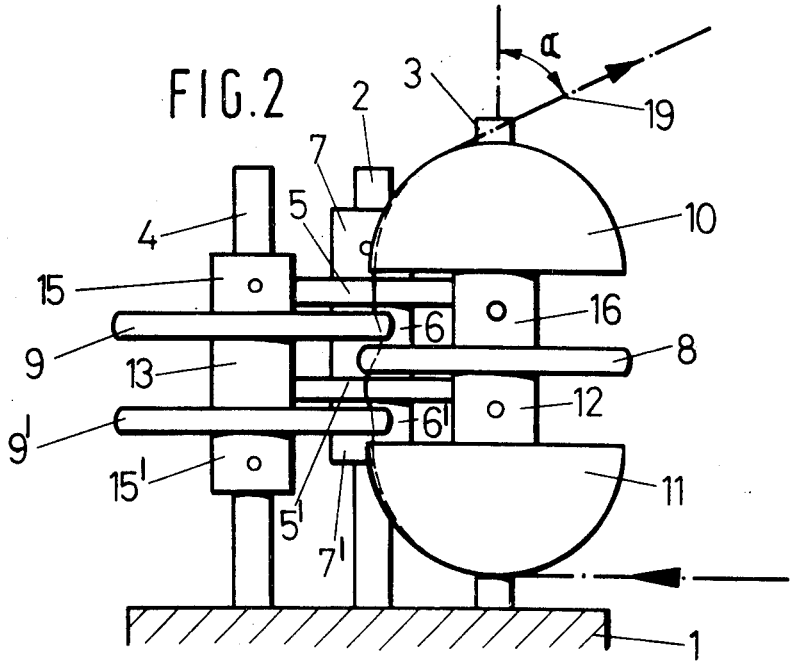
FIG. 2 is a front elevation of a second false-twister.

The false-twister in FIG. 2 is similar to that in FIG. 1 except that the hemisphere 11 is arranged on the same axis of rotation as the hemisphere 10, and the friction disc 9′ is fixed on the shaft 4 by a further ring 15′. The textile yarn 19 is then guided through the device upwardly from below, i.e., it is fed in a perpendicular direction with respect to the shaft 3 and over the surface of the hemisphere 11 to the overlapping discs and then over the surface of the hemisphere 10 to be withdrawn at an angle of 60° with respect to the axis of the shaft 3.

The device of the present application has particularly the advantage relatively to previous friction false-twisters that the textile yarn is subjected to essentially smaller strain during false-twisting and that, therefore, yarn breakages can be kept within acceptable limits. Furthermore, the friction discs can be produced and mounted and adjusted more easily and more cheaply because of the larger admissible tolerances in the arrangement, which is of particular importance when replacing friction discs removed for repair.

I claim:

1. A device for friction false-twisting textile yarn comprising a support, three substantially parallel shafts mounted on said support with their axes, in plan view, at the corners of an equilateral triangle, each shaft mounted for rotation about its longitudinal axis, a first friction element presenting a convex surface of revolution about an axis fixed coaxially on one of said shafts, said first friction element being formed so that the axis of said one of said shafts intersects a convex end portion of said convex surface, a second friction element presenting a convex surface of revolution about an axis and fixed coaxially on a different one of said shafts, said second friction element being substantially similar to said first friction element and inverted relatively to said first friction element to present a convex end portion of its convex surface facing oppositely to said first mentioned end portion, said first and second friction elements being axially displaced from one another with respect to the axes of said plurality of shafts, a plurality of circular disc-like friction members distributed between and fixed coaxially to all three of said shafts between said first and second friction elements in spaced relation therewith, said disc-like members being formed so that their edges overlap in spaced relation with respect to one another, guiding means for guiding yarn to be false twisted transversely to said axis of revolution of said first friction element to pass over the convex end portion thereof and then sinuously over overlapping edges of said disc-like members to said second friction element, and guiding means for guiding yarn transversely to said axis of revolution of said second friction element after passing to the convex end portion of said second friction element.

2. A device for friction false-twisting textile yarn comprising a support, three substantially parallel shafts mounted on said support with their axes, in plan view, at the corners of an equilateral triangle, each shaft mounted for rotation about its longitudinal axis, a first friction element presenting a convex surface of revolution about an axis fixed co-axially on one of said shafts, said first friction element being formed so that the axis of said one of said shafts intersects a convex end portion of said convex surface, a second friction element presenting a convex surface of revolution about an axis and fixed coaxially to one of said shafts, said second friction element being substantially similar to said first friction element and inverted relatively to said first friction element to present a convex end portion of its convex surface facing oppositely to said first mentioned end portion, said first and second friction elements being axially displaced from one another with respect to the axes of said plurality of shafts, a plurality of circular disc-like friction members distributed between and fixed co-axially to said shafts between said first and second friction elements in spaced relation therewith, said disc-like members being formed so that their edges overlap in spaced relation with respect to one another, guiding means for guiding yarn to be false twisted transversely to said axis of revolution of said first friction element to pass over the convex end portion thereof and then sinuously over overlapping edges of said disc-like members to said second friction element, and guiding means for guiding yarn transversely to said axis of revolution of said second friction element after passing to the convex end portion of said second friction element, each said convex friction element being formed with a flat base from which the surface of revolution extends, and the bases of said convex friction elements and all said disc-like members having equal diameters.

3. A device according to claim 2, in which said first and second friction elements are fixed to the same shaft.

* * * * *